US006199678B1

(12) United States Patent
Reo

(10) Patent No.: US 6,199,678 B1
(45) Date of Patent: Mar. 13, 2001

(54) HAND RAIL DRIVING APPARATUS FOR ESCALATOR

(75) Inventor: Seung Dae Reo, Kyoungsangnam-Do (KR)

(73) Assignee: LG Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 09/184,881

(22) Filed: Nov. 3, 1998

(30) Foreign Application Priority Data

Nov. 3, 1997 (KR) ..... 97-57650

(51) Int. Cl.[7] ..... B66B 23/00
(52) U.S. Cl. ..... 198/330; 331/336
(58) Field of Search ..... 198/330, 331, 198/336, 337

(56) References Cited

U.S. PATENT DOCUMENTS

| | | | | |
|---|---|---|---|---|
| 2,906,390 | * | 9/1959 | Hefti | 198/330 |
| 2,979,180 | * | 4/1961 | Cole | 198/337 |
| 3,499,340 | * | 3/1970 | Teranishi et al. | 198/330 |
| 4,227,605 | | 10/1980 | Höfling | 198/331 |
| 4,875,568 | | 10/1989 | Hermann et al. | 198/335 |
| 4,998,613 | | 3/1991 | Rivera et al. | 198/335 |
| 5,125,494 | * | 6/1992 | Nurnberg et al. | 198/330 |
| 5,566,810 | * | 10/1996 | Meyer et al. | 198/331 |
| 5,755,315 | * | 5/1998 | Wallbaum et al. | 198/331 |
| 5,819,910 | * | 10/1998 | Langer et al. | 198/330 |

FOREIGN PATENT DOCUMENTS

| | | | | |
|---|---|---|---|---|
| 391440 | * | 4/1933 | (GB) | 198/336 |
| 54-15285 | * | 2/1979 | (JP) | 198/331 |

* cited by examiner

*Primary Examiner*—Douglas Hess

(57) ABSTRACT

The present invention comprises a hand rail driving apparatus which can easily compensate loss of driving force and tension of a hand rail, which is essential to safety of an escalator without damaging a flat belt or a roller thereof. The hand rail driving apparatus includes an escalator in which a hand rail is contacted with pressure on a hand rail driving pulley, connected through a driving chain to a driving wheel, and in which the hand rail driving apparatus drives the hand rail while exerting pressure on the hand rail by using the driving pulley. A tube, in which air pressure therein is variable, is mounted on a circumferential surface of the hand rail driving pulley to which the hand rail is contacted with pressure. A hand rail driving apparatus includes a roller unit for exerting pressure on both upper and lower surfaces of the hand rail when driving the hand rail by contacting with pressure on hand rail on a plurality by driving rollers, and a plurality of driven rollers corresponding to the driving rollers, and tension rollers for transmitting power from a driving wheel to the roller unit. The tube is mounted on circumferential surfaces of each of the driving rollers of the roller unit.

10 Claims, 12 Drawing Sheets

HAND RAIL DRIVING APPARATUS FOR ESCALATOR

BACKGROUND OF THE INVENTION

1. Field of the Invention

The present invention is related to a hand rail driving apparatus of an escalator which drives a hand rail the same direction as steps which move passengers.

2. Description of the Prior Art

The escalator generally includes a driving motor 4, a reducing drive 5 for reducing a turning effect of the motor, a driving chain 6 for transmitting the turning effect of the reducing drive to a driving sprocket 7, and a driving wheel 8 positioned in an upper portion of a machine room 3, as shown in FIG. 1.

Supporting balustrades 2 and the hand rails 1 are mounted on both sides of the escalator for the sake of passengers. Steps 9, on which the passengers board, are fixed in a step chain 10. The steps move along guide rails together with the step chain while being supported by four step rollers, not shown in the figure.

In addition, a driven wheel 11, to which a chain tension device having a tension spring is attached, is mounted in a lower portion of the machine room for preventing deflection of the step chain 10.

Reference number 12 indicates a driving axis for connecting the driving wheels 8 on both side of the escalator.

FIG. 2A to 2C depict several examples of the conventional hand rail driving apparatus.

FIG. 2A shows a hand rail driving apparatus using pressure of a flat belt. A hand rail driving pulley 13 is connected with use of a driving chain 14 to the driving wheel 8 which moves the steps. The hand rail driving apparatus drives the hand rail 1 by exerting pressure of the flat belt 15 on a contacting point with the hand rail of the hand rail driving pulley 13.

FIG. 2B depicts another hand rail driving apparatus using tension. In that apparatus, the hand rail driving pulley 13 is also connected with use of a driving chain 14 to the driving wheel 8 which moves the steps. The hand rail driving apparatus includes a tension roller 19 in the driving chain 14. The apparatus controls tension of the driving chain, thus driving the hand rail.

In the apparatus using the pressure of the flat belt or the tension as described above, the hand rail driving pulley 13 is connected to the driving wheel 8 through the driving chain 14, thus moving the hand rail 1 in the same direction and at the same speed as the step 9. In the hand rail driving pulley 13 used in these types of apparatus, a frictional elastic body 16 which is made of rubber or urethane is provided by surface treatment, thus driving the hand rail with use of tension and friction of the flat belt 15, as shown in FIG. 3A and 3B.

FIG. 2C shows another conventional hand rail driving apparatus using contacting pressure of a roller. In that apparatus, the driving chain 14 transmits power of the driving wheel 8 to tension rollers 17. A roller driving device 18 is rotated by the tension rollers 17, thus driving the hand rails 1 by exerting a constant contacting pressure on upper and lower surfaces of the hand rails 1.

The roller driving device 18 includes a plurality of driving rollers 18*a* and a plurality of driven rollers 18*b* which are mounted in a number corresponding to the driving rollers. The hand rail 1 is interposed between the driving rollers 18*a* and the driven rollers 18*b*, thus preserving the constant contacting pressure on the upper and lower surfaces of the hand rail 1.

The frictional elastic body 16 or the tension is used for exerting a driving force of the hand rail 1 which is more than a fixed loss by bending resistivity($e^{\mu\theta}$, friction coefficient, θ: angle), and a pure friction force($\mu$×m ) which increase proportionally corresponding to a change in a rise of an escalator.

However, when the rise of escalator increases, the hand rail driving apparatus of the conventional escalator as described above, needs to increase the tension of the flat belt 15 or to increase the contacting pressure between the driving rollers 18*a* and the driven rollers 18*b* in order to obtain a required driving force of the hand rail 1. In addition, when increasing the tension and the contacting pressure, it can not only damage the flat belt 15 and the rollers 18*a* and 18*b* but also cause damage of the hand rail 1.

Also, the increase of the driving force, that is, the increase of the tension and the contacting pressure causes decrease of the friction coefficient according to change of properties, thus making a normal operation of the hand rail 1 impossible.

On the other hand, in a conventional method of driving the hand rail of the escalator, a moving velocity of the hand rail 1 is determined by diameters of the hand rail driving pulley 13 and the driving roller 18*a*. However, when the diameters change by the wear of the hand rail 1, the moving velocity of the hand rail 1 is not sufficiently compensated, thus causing problems of depreciating safety and convenience of the passengers.

In addition, when driving the hand rail 1, severe vibrations are generated in the rate of 50–60[gal]. The conventional hand rail driving apparatus also has problems in which the vibration of the hand rail 1 is transmitted to the passengers directly.

Furthermore, because the hand rail 1 is driven by contacting friction of the frictional elastic body 16, the apparatus acts with sufficient driving force only when there is no alien substance between the hand rail 1 and the frictional elastic body 16, i.e., an indoor escalator. However, when rain, dust, and so on are collected therebetween such as in an outdoor location, the friction coefficient for driving the hand rail is decreased, degrading durability and reliance of the hand rail 1. Therefore, there have been needs for correcting the above problems.

SUMMARY OF THE INVENTION

The present invention, therefore, is created to overcome the mentioned difficulties. Objects of the present invention are to provide new and improved hand rail driving apparatus which can easily compensate loss of a driving force and a tension of a hand rail, which is essential to safety of an escalator without damaging a flat belt or a roller, prevent vibration, generated in driving the hand rail, from being directly transmitted to the passengers; and prevent durability of the hand rail driving apparatus from being degraded by the interposition of an alien substance.

To accomplish the above objects, a first embodiment of the present invention contemplates the provision of a hand rail driving apparatus of an escalator in which a hand rail is contacted with pressure on a hand rail driving pulley, connected through a driving chain to a driving wheel, and in which the hand rail driving apparatus drives the hand rail while exerting pressure on the hand rail by using the driving pulley, comprising a tube, in which air pressure therein is variable, mounted on a circumferential surface of the hand rail driving pulley to which the hand rail is contacted with pressure.

To achieve the above object, the second embodiment of the present invention provides a hand rail driving apparatus comprising a roller unit for exerting pressure on both upper and lower surfaces of the hand rail when driving the hand rail by contacting with pressure the hand rail on a plurality of driving rollers and a plurality of driven rollers corresponding to the driving rollers, and tension rollers for transmitting power from a driving wheel to the roller unit, further comprising, a tube, in which air pressure therein is variable, mounted on a circumferential surface of the driving rollers of the roller unit.

In each embodiment of the present invention, the tube comprises a wave-shaped tread formed on a surface, contacting the hand rail, in a tangential direction thereof so as to eliminate an alien substance from being interposed in an inner circumferential surface, when the hand rail is driven by the hand rail driving pulley.

The tube, on which the wave-shaped tread is mounted, also comprises an air inlet for remotely blowing air from a remote air source, and wherein a diameter of the tube is controllable according to the air pressure in the tube, such that the driving force of the hand rail can be controlled.

BRIEF DESCRIPTION OF THE DRAWINGS

Above objects and other advantages of the present invention will be apparent by reference to the following description taken in conjunction with the accompanying drawings, in which.

DETAILED DESCRIPTION OF THE INVENTION

Hereinafter, each preferred embodiment of the hand rail driving apparatus according to the present invention will be described in detail with reference to the accompanying drawings.

Figure 1:
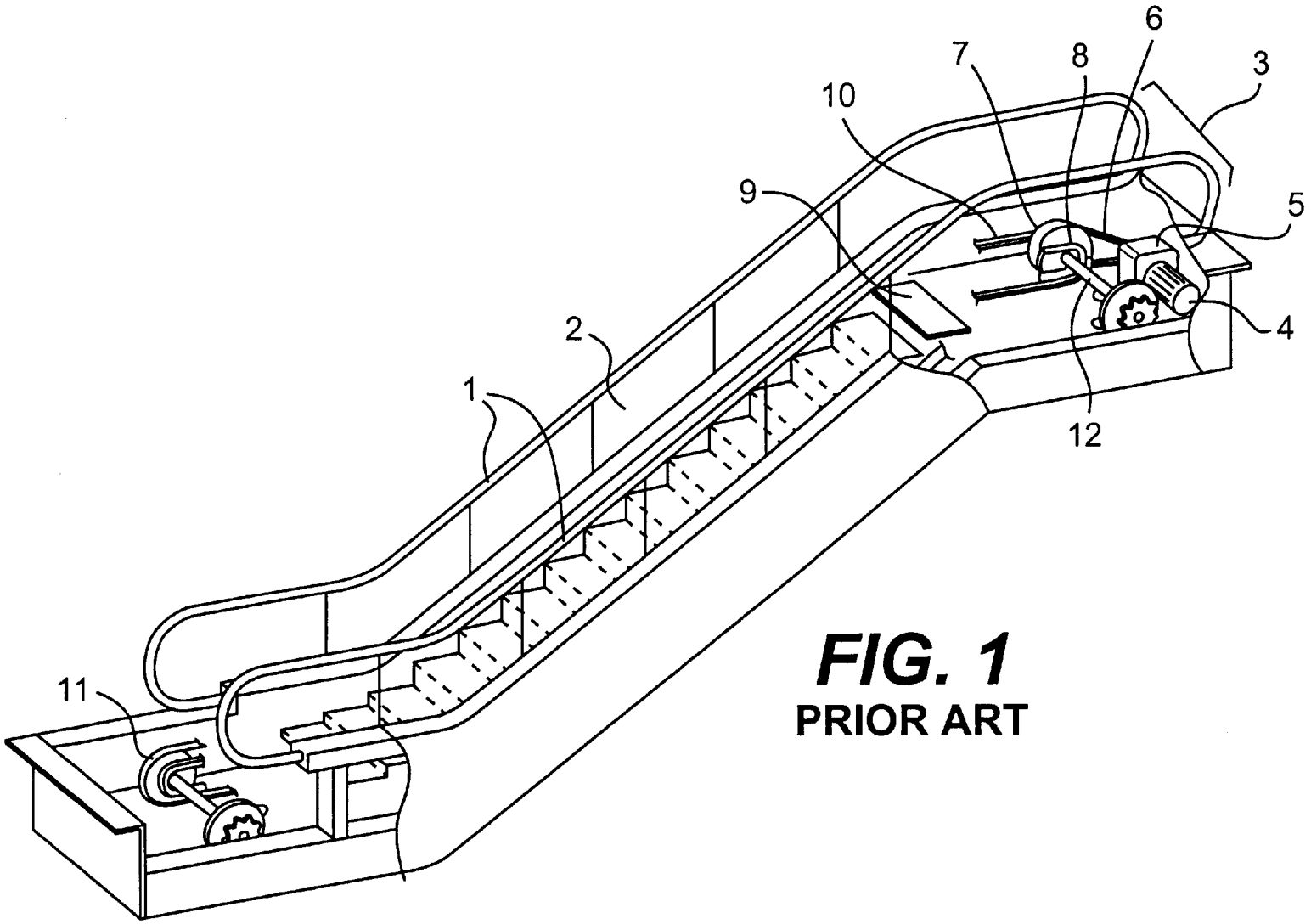
FIG. 1 PRIOR ART
FIG. 1 is a perspective view showing construction of a conventional escalator.
Figure 2A:
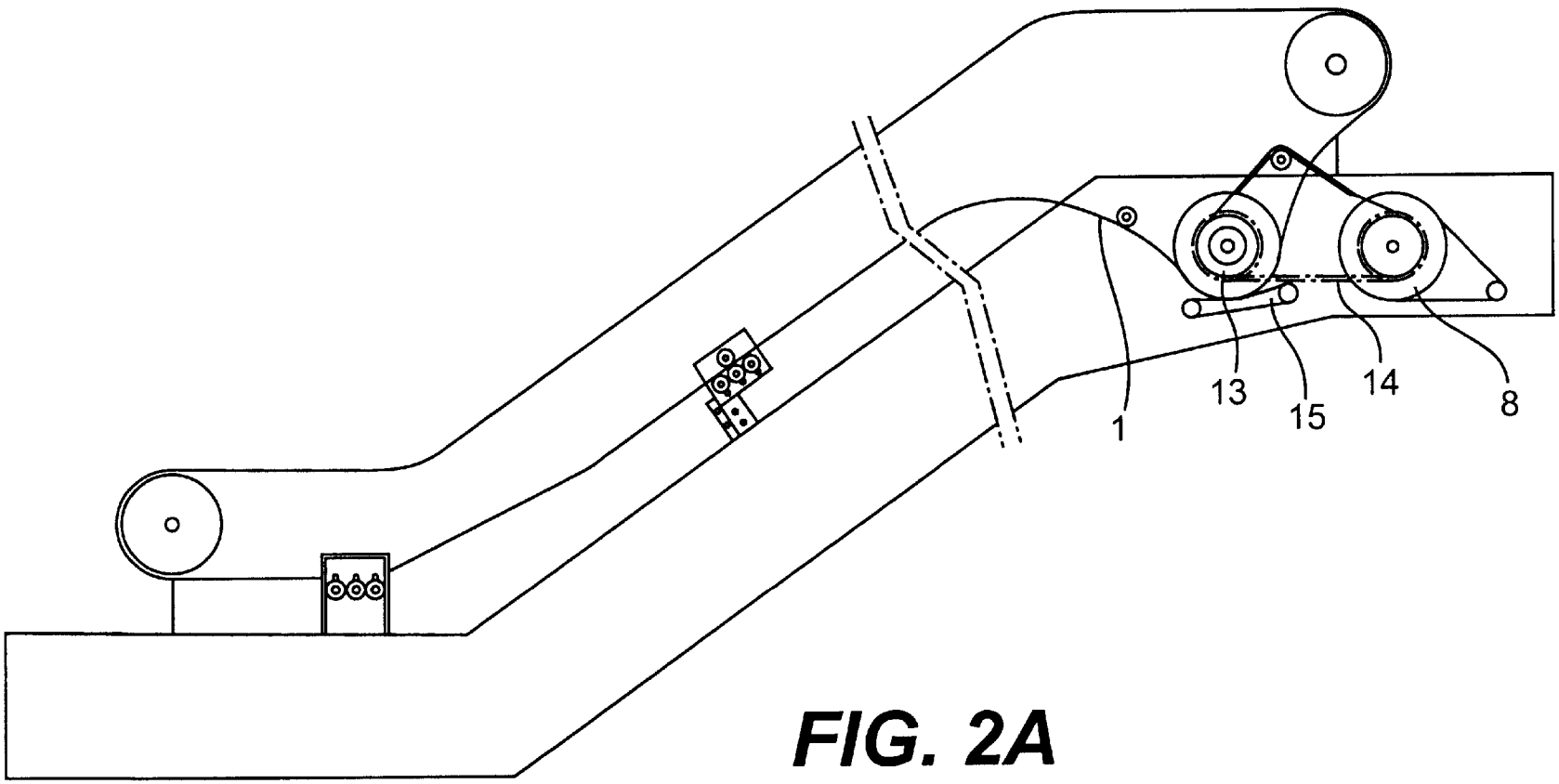
FIG. 2A PRIOR ART
FIG. 2A to 2C show compositions of a conventional hand rail driving apparatus, each of which uses pressure of a flat belt, tension, and contacting pressure of a roller.
Figure 2B:
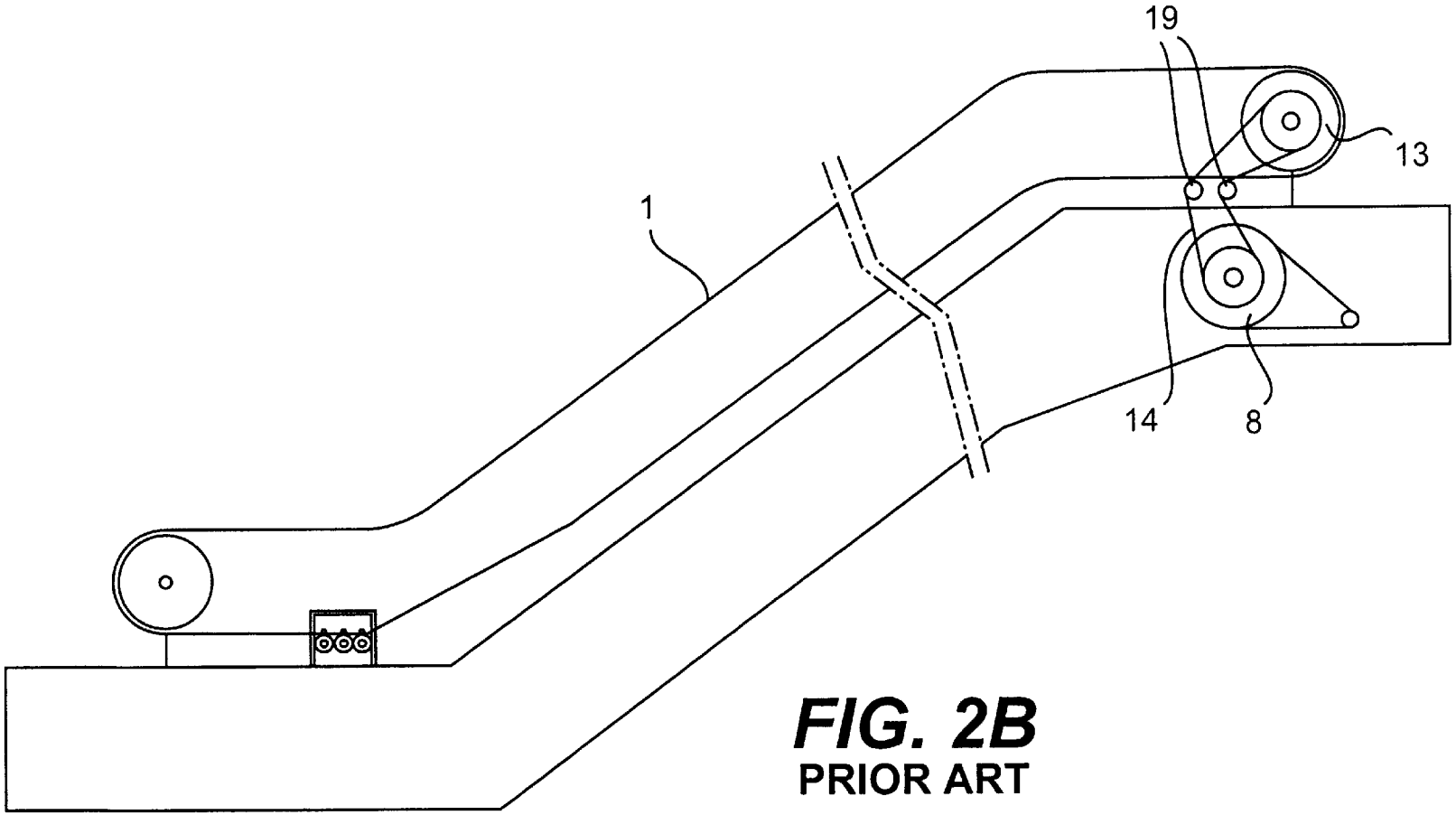
FIG. 2B PRIOR ART
Figure 2C:
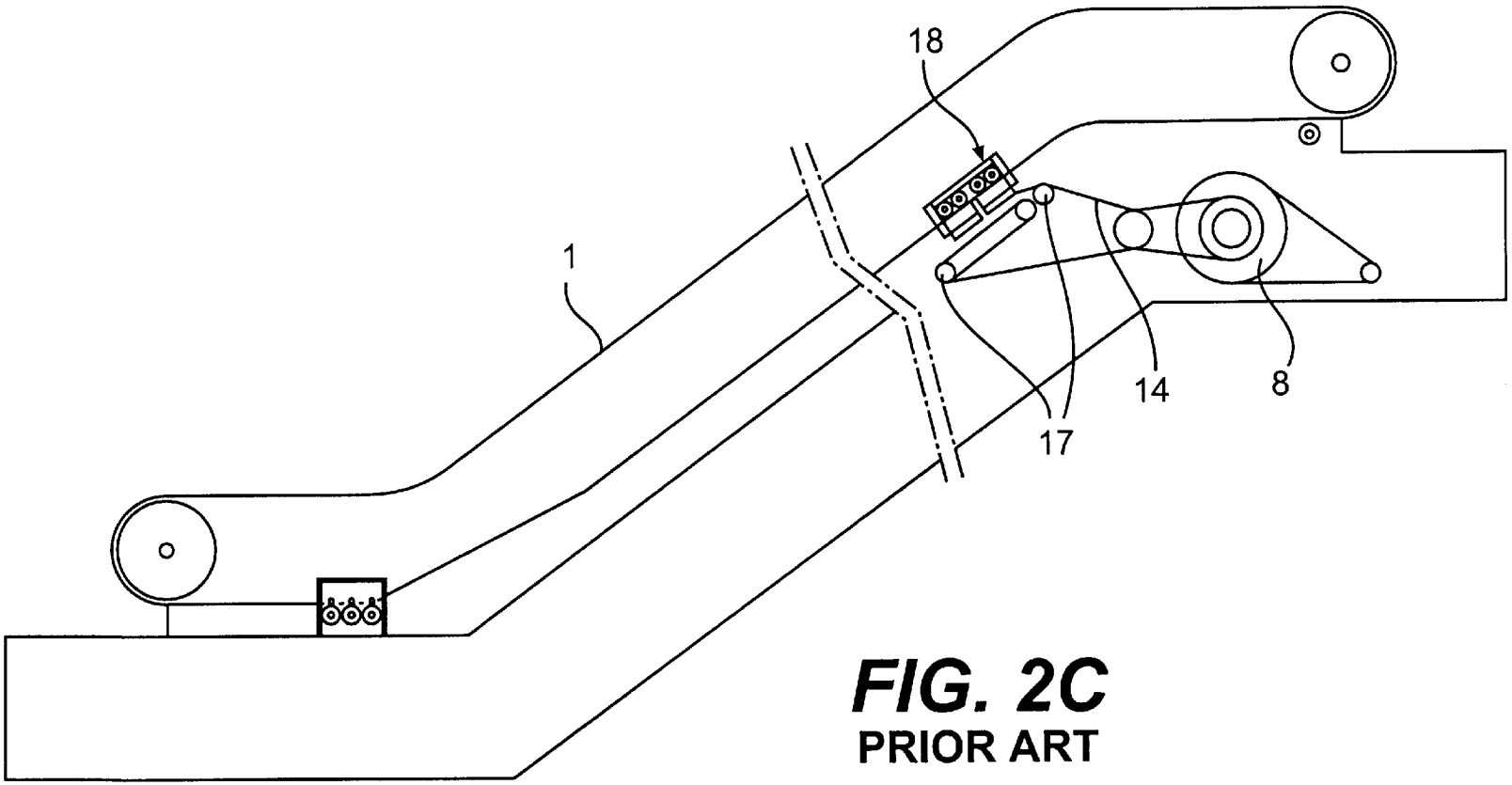
FIG. 2C PRIOR ART
Figure 3A:
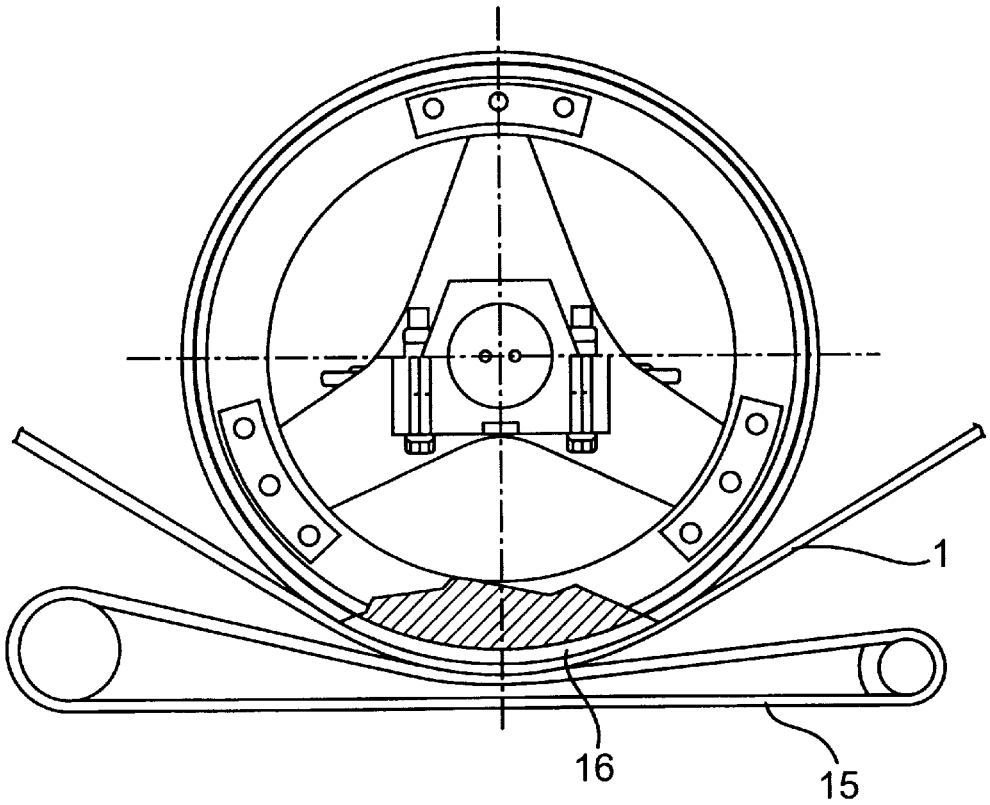
FIG. 3A PRIOR ART
FIG. 3A and 3B show front and side views of a conventional hand rail driving pulley.
Figure 3B:
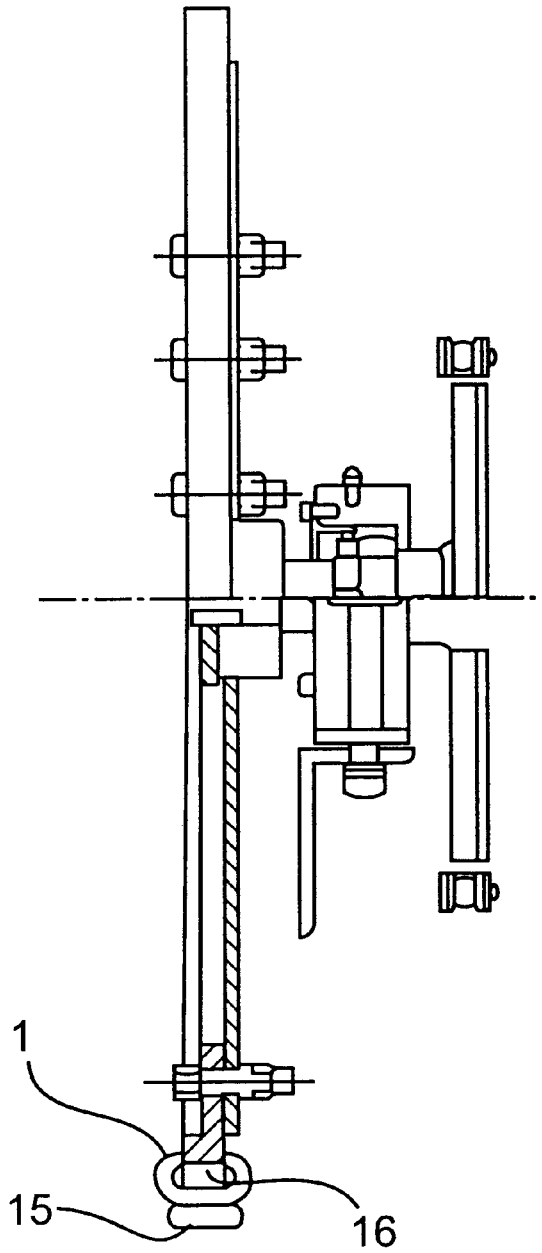
FIG. 3B PRIOR ART
Figure 4A:
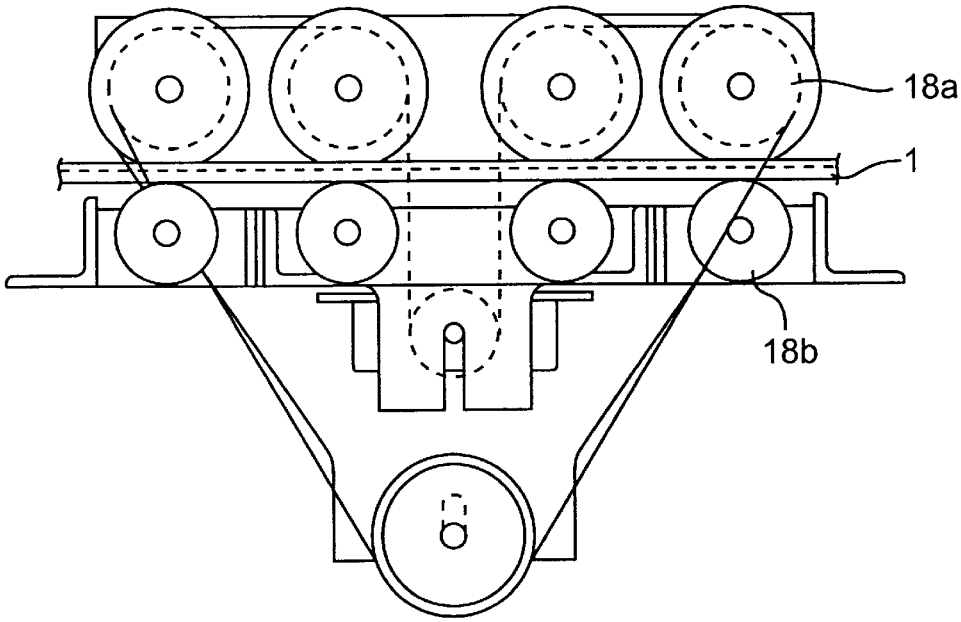
FIG. 4A PRIOR ART
FIG. 4A and 4B show front and side views of a conventional hand rail roller driving device.
Figure 4B:
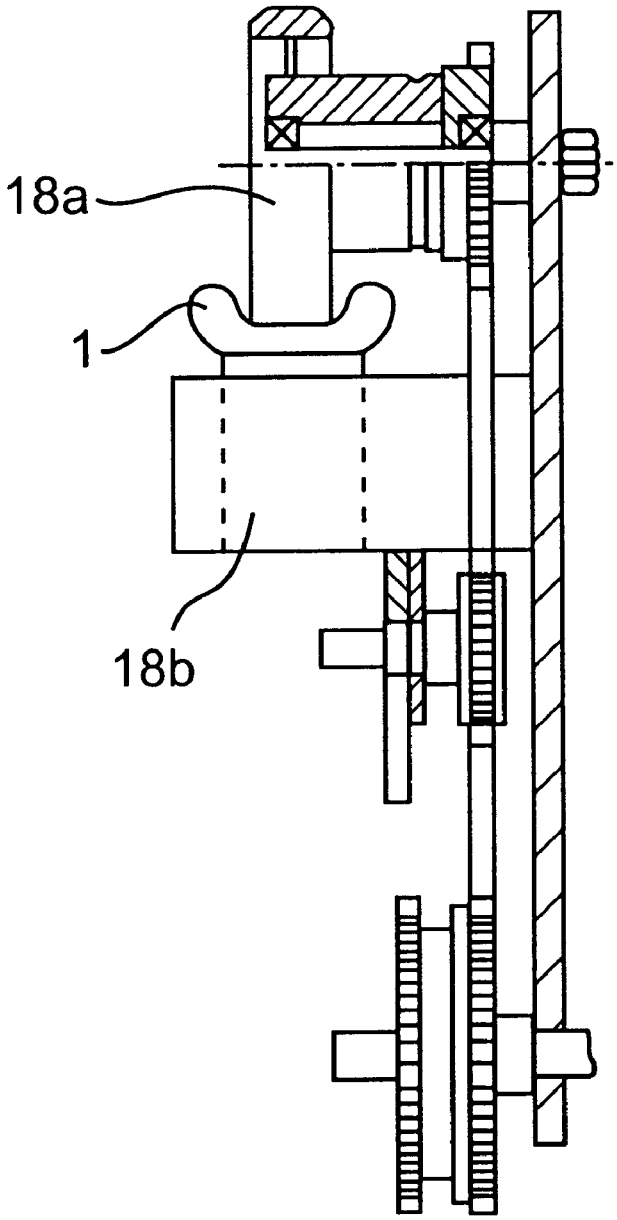
FIG. 4B PRIOR ART
Figure 5A:
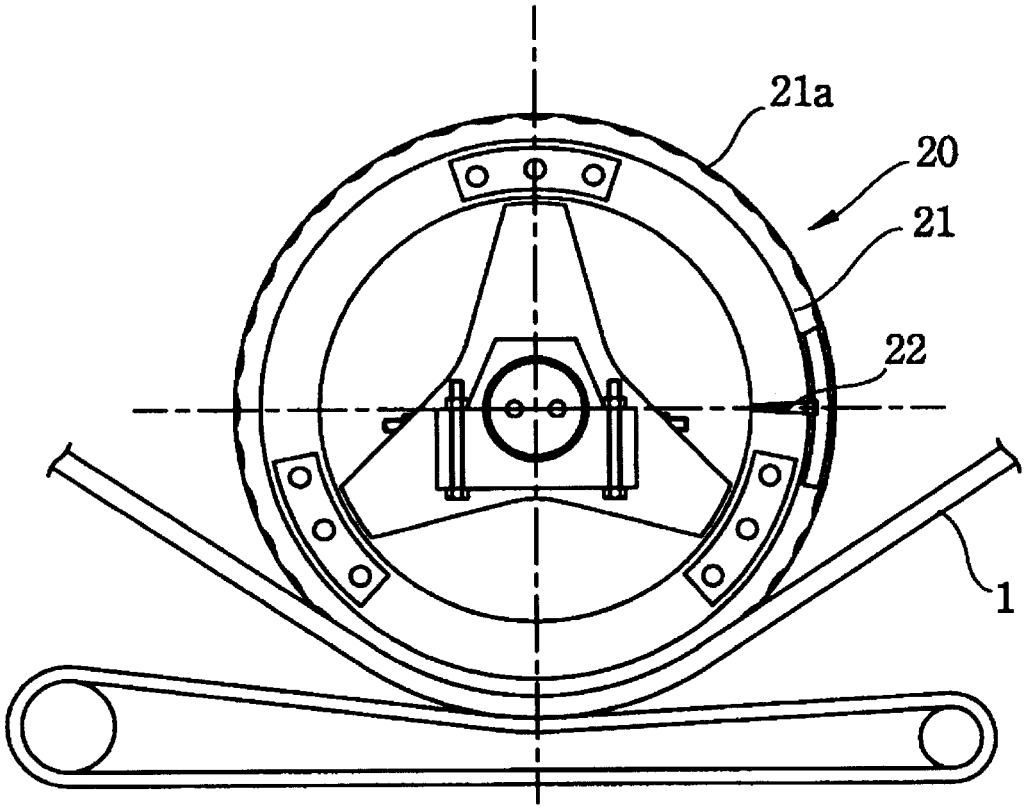
FIG. 5A to 5C show front and side views of the hand rail driving pulley and a detailed view of portion A for illustrating an embodiment of the present invention.
Figure 5B:
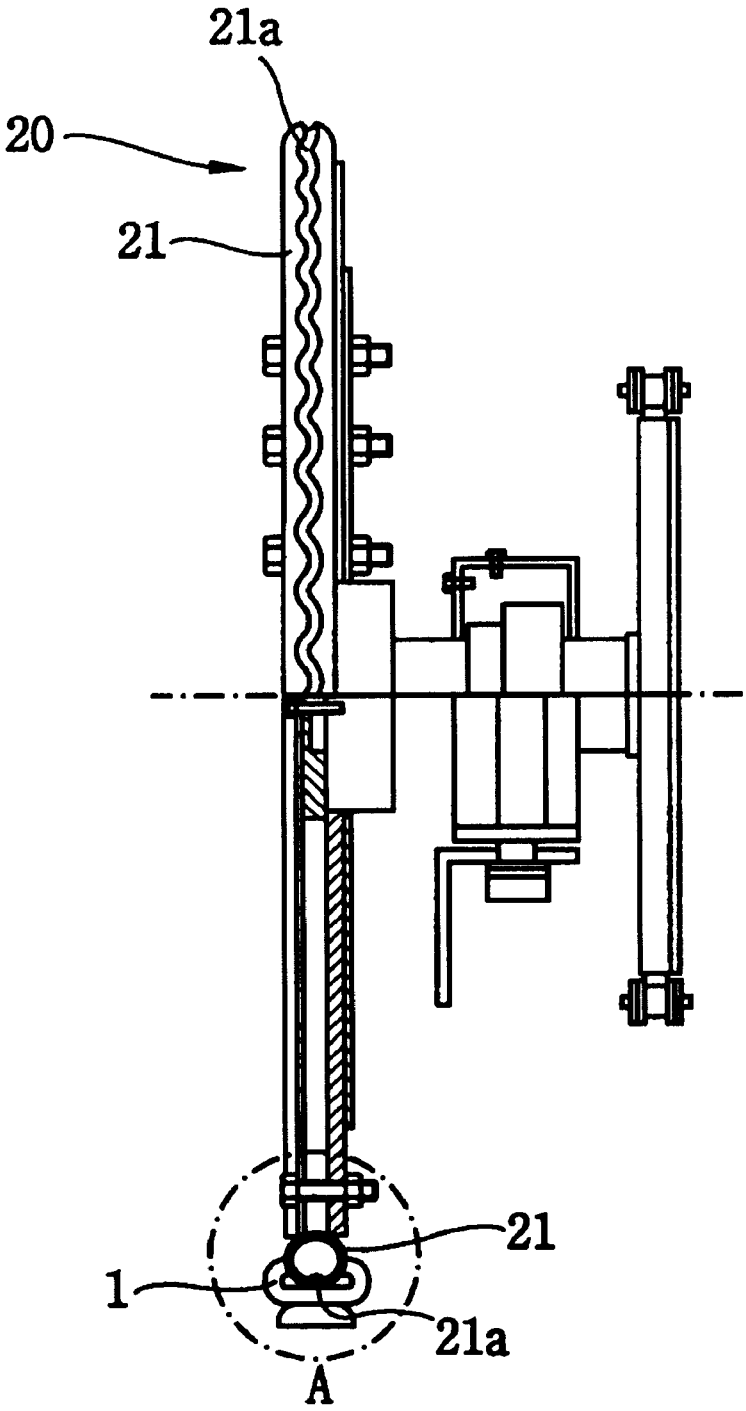
Figure 5C:
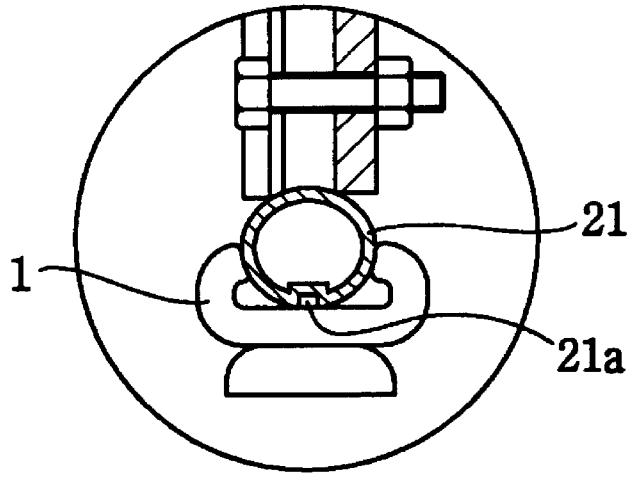

FIG. 5A is a front view of the hand rail driving apparatus for explaining an embodiment of the present invention. FIG. 5B is a side view of FIG. 5A of which a portion is cut away in a section view. FIG. 5C is a section view showing portion A of the FIG. 5B in detail. A tube 21 is mounted along a circumferential surface of a hand rail driving pulley 20 connected to a driving wheel by a driving chain. A hand rail 1 is contacted to the hand rail driving pulley 20, on which the tube 21 is mounted, by pressure with use of tension of a flat belt 15. The hand rail driving apparatus of the escalator drives the hand rail 1 by exerting pressure on the hand rail driving pulley 20, as shown in the figures.

The tube 21 at this time can be provided with a wave-shaped tread 21*a* on a surface, contacting with the hand rail, along a tangential direction thereof. The tube 21 can also include an air inlet 22 for remotely blowing air from the remote air source, thus controlling the diameter of the tube according to an air pressure therein. The air inlet 22 is preferably disposed in a position in which it is possible to remotely inject air from a remote air source.

The air from the remote air source can be supplied by connecting an air hose to the inlet 22 via a volume controllable valve.

Figure 6A:
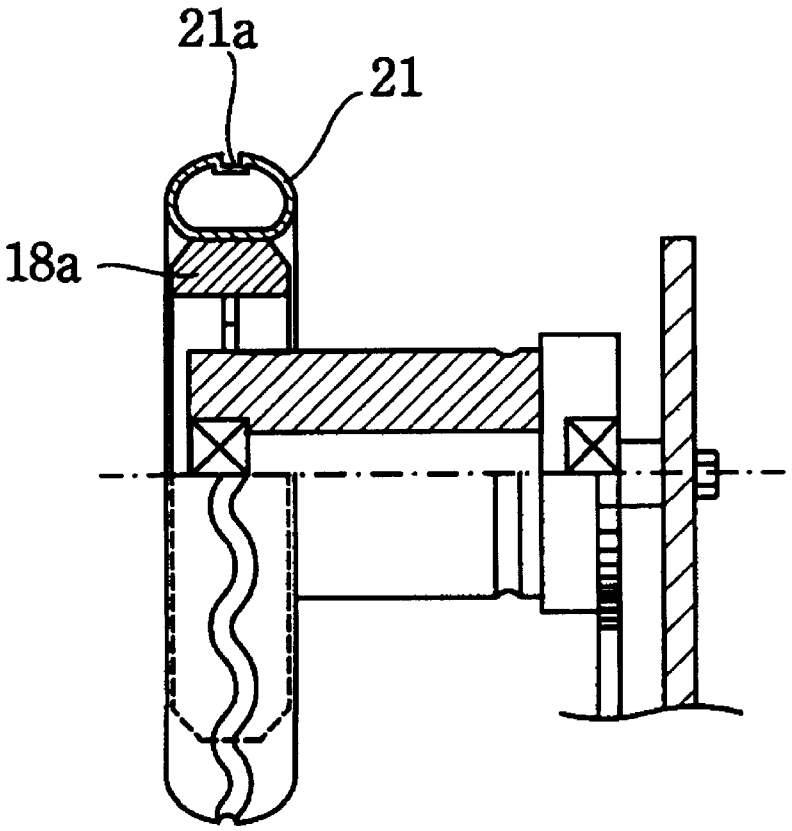
FIG. 6A and 6B show side views of the hand rail driving pulley for explaining another embodiment of the present invention.
Figure 6B:
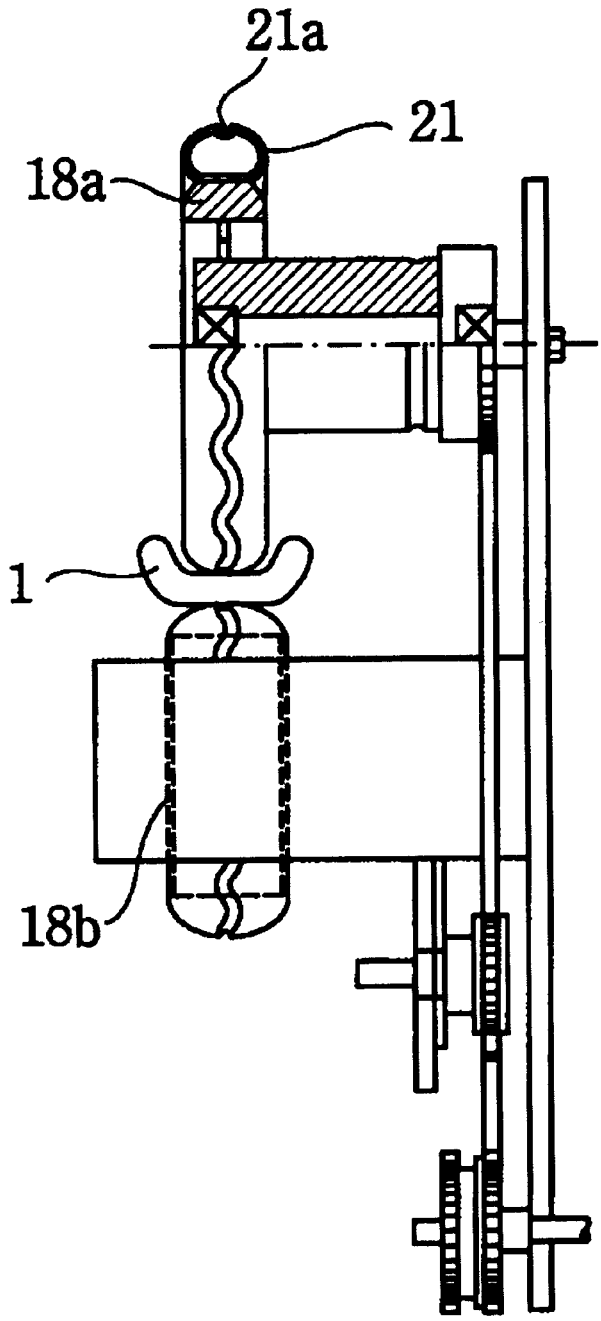

FIG. 6A and 6B show another embodiment of the hand rail driving apparatus. In the apparatus, the hand rail 1 is contacted with pressure by a plurality of driven rollers 18*b* of which number is corresponding to a plurality of the driving rollers 18*a*. The apparatus drives the hand rail with use of a roller unit which exerts pressure on/under the hand rail 1 when driving the hand rail. A side view of the roller unit is shown in FIG. 6A, in which a portion of the driving roller 18*a*, in which the tube 21 is mounted along the circumferential surface, is cut in a section view. FIG. 6B is a side view showing that the tubes 21 are mounted on each of the circumferential surfaces of the driving roller 18*a* and the driven roller 18*b* of the roller driving device.

At this point, the tube can be mounted not only on the driving roller 18*a* of the roller unit, as shown in FIG. 6A, but also on both of the driving roller 18*a* and the driven roller 18*b*. The tube may also be mounted only on the driven roller 18*b*, as the case may be.

The tube 21 can also be provided with a wave-shaped tread 21*a* on a surface, contacting with the hand rail, along a tangential direction thereof. The tube 21 can also include the air inlet 22 for remotely blowing air from the remote air source, controlling the diameter of the tube according to an air pressure therein. The air inlet 22 is preferably formed in a position in which it is possible to remotely inject air from the remote air source.

Hereinafter, operations and effects of the hand rail driving apparatus of the escalator are described.

At first, as shown in FIG. 5A to 5C, the tube 21 is mounted on the hand rail driving pulley 20. Then, while the tube 21 is contacted by pressure to the hand rail 1, power is transmitted to the hand rail driving pulley 20 by using a driving chain (not shown) while exerting pressure on the hand rail 1 with use of tension of the flat belt 15. Then, because the hand rail 1 is closely attached to the tube 21, when the hand rail driving pulley 20 rotates, the turning effect is easily transmitted to the hand rail 1, thus driving the hand rail 1.

At this time, the wave-shaped tread 21*a*, which has a depression region as a groove on a surface of the tube, is contacted with pressure on an inner circumferential surface. When the hand rail 1 is driven as the above manner, the tread 21*a* of the tube 21 moves along the inner circumferential surface in an opposite direction to the hand rail, just like waving thereagainst. The above operation of the tread, therefore, can eliminate an alien substance from being interposed between the hand rail and the hand rail driving pulley.

In addition, air in the tube 21 plays a role of an absorber against the vibration which is generated in driving the hand rail. The tube 21 therefore may prevent the vibration, generated at the hand rail 1, from being directly transmitted to the passengers.

The amount of the air in the tube 21 can be controlled by connecting the air inlet 22 via the air hose and the air supplying volume controllable valve to the remote air source. Therefore, when the moving velocity of the hand rail is changed by an exterior condition (for example, in case that the hand rail driving pulley or the hand rail is worn away to cause a pressure decrease on the hand rail), air can be blown into (or, blown out of) the tube 21 through the air inlet 22, formed on the tube 21, so as to increase (or, decrease) the air pressure inside of the tube. That makes the tension, exerted on the hand rail 1, i.e., the pressure being easily controlled. The tube 21, in which the pressure is controlled as described above, is closely attached on the hand rail 1 when moving the hand rail 1.

On the other hand, another embodiment of the present invention can be implemented in a method wherein the roller driving device drives the hand rail 1 while being contacted with pressure on both of the upper and lower surfaces of the hand rail 1. When the tube is mounted on the driving roller 18*a* (or, driving roller 18*a* and the driven roller 18*b*), the above principle can also be applied, so that the hand rail may be driven while controlling the tension exerted on the hand rail.

As fully explained hereinabove, the hand rail driving apparatus of the present invention has an advantage of easily obtaining a driving force by controlling air pressure in a tube, mounted in the hand rail driving pulley or the roller, without damaging the hand rail, when the rise of the escalator increases.

In addition, because the diameter of the tube varies according to the amount of air injected into the tube, a decrease of the moving velocity of the hand rail owing to potential abrasions can be compensated. Furthermore, because the vibration, generated in driving the hand rail, can be absorbed by the air in the tube, the vibration of the hand rail can be prevented from being directly transmitted to the passengers.

Also, for the reason that an alien substance can be prevented from being interposed between the hand rail and the rubber band by using the tread on the surface thereof, the increase of the frictional coefficient can be hindered, so being usefully installed in an outside location.

What is claimed is:

1. A hand rail driving apparatus of an escalator in which a hand rail is contacted with pressure on a hand rail driving pulley, connected through a driving chain to a driving wheel, and in which the hand rail driving apparatus drive the hand rail while exerting pressure on the hand rail by using the driving pulley, comprising, a tube for accommodating air, in which an air pressure therein is variable, said tube being mounted on a circumferential surface of the hand rail driving pulley to which the hand rail is contacted with pressure.

2. The hand rail driving apparatus as claimed in claim 1, wherein the tube comprises a wave-shaped tread formed on a surface, contacting with the hand rail, in a tangential direction thereof.

3. The hand rail driving apparatus as claimed in claim 2, wherein the tube includes an air inlet therein for receiving air from a remote air source, and wherein a diameter of the tube is controllable according to air pressure in the tube.

4. A hand rail driving apparatus comprising a roller unit for exerting pressure on both upper and lower surfaces of the hand rail when driving the hand rail by contacting pressure on the hand rail on a plurality of driving rollers and a plurality of driven rollers corresponding to the driving rollers, and tension rollers for transmitting power from a driving wheel to the roller unit, further comprising, a tube for accommodating air, in which an air pressure therein is variable, said tube being mounted on a circumferential surface of the driving rollers of the roller unit.

5. The hand rail driving apparatus as claimed in claim 4, wherein the tube comprises a wave-shaped tread formed on a surface, contacting with the hand rail, in a tangential direction thereof.

6. The hand rail driving apparatus as claimed in claim 5, wherein the tube includes an air inlet therein for receiving air from a remote air source, and wherein a diameter of the tube is controllable according to air pressure in the tube.

7. The hand rail driving apparatus as claimed in claim 4, wherein the tube includes an air inlet therein for receiving air from a remote air source, and wherein a diameter of the tube is controllable according to air pressure in the tube.

8. The hand rail driving apparatus as claimed in claim 4, wherein a plurality of the tubes are provided in which an air pressure is variable, each tube being mounted on each circumferential surface of the driving rollers and driven rollers of the roller unit.

9. The hand rail driving apparatus as claimed in claim 8, wherein a tube comprises a wave-shaped tread formed on a surface, contacting with the hand rail, in a tangential direction thereof.

10. The hand rail driving apparatus as claimed in claim 8, wherein each tube includes an air inlet therein for receiving air from a remote air source, and wherein a diameter of the tube is controllable according to air pressure in the tube.

* * * * *